US007469562B2

(12) United States Patent
Bausch et al.

(10) Patent No.: US 7,469,562 B2
(45) Date of Patent: Dec. 30, 2008

(54) MACHINE KNITTING NEEDLE

(75) Inventors: Albert Bausch, Burladingen-Melchingen (DE); Jorg Sauter, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 11/979,786

(22) Filed: Nov. 8, 2007

(65) Prior Publication Data

US 2008/0141730 A1 Jun. 19, 2008

(51) Int. Cl.
*D04B 35/04* (2006.01)

(52) U.S. Cl. ..... 66/121

(58) Field of Classification Search ..... 66/116, 66/120, 121, 122, 123
See application file for complete search history.

(56) References Cited

U.S. PATENT DOCUMENTS

| | | | | | |
|---|---|---|---|---|---|
| 757,378 | A | * | 4/1904 | Woodward | 66/121 |
| 1,022,238 | A | * | 4/1912 | Heaton | 66/121 |
| 1,629,275 | A | * | 5/1927 | Kennedy | 66/121 |
| 1,629,725 | A | | 5/1927 | Moore | |
| 3,063,274 | A | * | 11/1962 | Kohl | 66/203 |
| 3,164,000 | A | | 1/1965 | Ashe | |
| 4,210,003 | A | * | 7/1980 | Sqrillo et al. | 66/116 |
| 4,294,086 | A | | 10/1981 | Mayer et al. | |
| 4,548,056 | A | * | 10/1985 | Schuler et al. | 66/121 |
| 4,791,794 | A | * | 12/1988 | Schmoll | 66/121 |
| 5,154,069 | A | * | 10/1992 | Speetjens et al. | 66/121 |
| 6,321,578 | B1 | * | 11/2001 | Apollonio | 66/215 |
| 7,191,620 | B2 | * | 3/2007 | Jurgens et al. | 66/121 |

FOREIGN PATENT DOCUMENTS

| | | |
|---|---|---|
| DE | 1113537 B | 9/1961 |
| DE | 27 14 607 | 10/1978 |
| DE | 3018699 | 5/1980 |
| DE | 2907569 B1 | 7/1980 |
| GB | 2169320 A | 7/1986 |

* cited by examiner

*Primary Examiner*—Danny Worrell
(74) *Attorney, Agent, or Firm*—Norman N. Kunitz; Fitch, Even, Tabin & Flannery

(57) ABSTRACT

In order to reduce the impact speed of a latch (4) of a needle (1) in back position by reducing the acceleration effect originating from a half stitch (19), the upward jaw slope (8) of the needle (1) is subdivided into different regions. A first section (12) ascends at a relatively large acute angle γ of, for example, up to 20°, preferably 16°. Just after the half stitch (19) has contacted the inside (14) of the latch (4), said half stitch arrives on a second section (16) of the upward jaw slope (8). The second section (16) is a straight section which ascends at a smaller acute angle β of, for example, only 14° or less. Consequently, an acceleration effect from the half stitch (19) on the latch (4) is avoided over a wide pivot range of said latch. Preferably, this acceleration-free pivot range is at least 90°, preferably greater than 110°.

10 Claims, 4 Drawing Sheets

MACHINE KNITTING NEEDLE

CROSS REFERENCE TO RELATED APPLICATION

This application claims the priority of European Patent Application No. 06 023 321.0, filed on Nov. 9, 2006, the subject matter of which, in its entirety, is incorporated herein by reference.

BACKGROUND OF THE INVENTION

The invention relates to a machine knitting needle which is intended, in particular, for high-speed circular knitting machines, however, basically also for all other types of knitting machines or even for warp knitting machines.

Machine knitting needles have been known, for example, from documents U.S. Pat. No. 1,629,725 or also from DE 29 07 569 B1. Increasingly, greater demands are made on such needles in view of higher knitting speeds. During the knitting operation, the needle is moved back and forth in longitudinal direction. In so doing, half stitches picked up by the hook of the needle slide onto the shaft, in which case they move a latch provided on the machine knitting needle into back position, for example. This motion is supported by the inherent inertia of the latch. Therefore, the latch moves back and forth between the closed position and the back position, in which case it alternately abuts against the hook and the shaft. In order to illustrate this, FIG. 5 shows such a needle P1. As a result of its acceleration due to the half stitch, the latch P2 is accelerated when the half stitch slides over the curved section P3 of the maximum jaw height. Consequently, the latch is accelerated by the half stitch in the relatively large angle range $\epsilon$, thus resulting in a high impact speed. As the knitting speed increases, the impact of the latch, in particular in back position, represents a problem regarding in view of the durability of a machine knitting needle. Thus, it must be ensured that no inadmissible wear of the knitting needle and, in particular, no breakage of the latch or of the needle body occur over the duration of use of the machine knitting needle.

In order to remedy this, it has already been attempted to dampen the impact of the latch when it pivots into the back position and abuts against the shaft. Regarding this, document DE 27 14 607 C3 discloses a special embodiment of the needle slit that is limited by more or less elastically configured shaft jaws. The elastic shaft jaws catch the latch in an elastic manner and thus dampen the impact.

However, it is also necessary to consider aspects that relate to the thread. For example, it may happen that the thread is partially cut on the latch. In conjunction with this, the cited DE 29 07 569 B1 provides the latch with a throat and configures the ascent from the hook to the breast of the needle with a relatively steep slope angle $\beta$. It is true, that this is more gentle on the thread but it leads to compromises with respect to the operating speed. In particular, as explained above, this results in a high latch impact speed of the latch at the shaft, when the latch impacts in back position.

The objective is to use latch-type needles that increasingly higher operating speeds.

With this in mind, it is the object of the invention to improve the machine knitting needles.

SUMMARY OF THE INVENTION

The above object generally is achieved with the machine knitting needle in accordance with the invention which needle comprises:

a needle shaft having a hook formed to its free end;

a latch, which is supported in a needle slit of the shaft by a latch bearing so as to by pivotable between a closed position and a back position;

wherein the shaft breast, starting from the hook and up to the latch bearing, has an upwardly inclined slope with a first section and with a second section; and wherein the second section inclined is straight and has a slope angle($\beta$) which is smaller than a slope angle ($\gamma$) defined by the first section.

Referring to the needle in accordance with the invention, the geometric configuration of the upward jaw slope reduces the stress on the latch and on the shaft when the latch impacts in back position and strikes the shaft. As a result of a second, straight section of the upward jaw slope, it is achieved that the speed of a half stitch that slides out of the inside space of the hook across the jaw slope does not become too great. Consequently, the speed transmitted from the half stitch to the latch is tolerable and lower than in prior art, in particular in accordance with FIG. 5.

Referring to conventional machine knitting needles, the jaw slope between the hook and the needle breast, is straight, for example, in which case the slope angle of the ascent of the jaws slope decreases only in the reversal region, that is, the highest point of the jaws slope measured on the needle back. Referring to the invention, a straight ascending section is upstream of the reversal region, said ascending section having a slope angle that is constant at all points and is smaller than the slope angle of the section of the rise of the jaw slope existing upstream thereof. The second, flatter straight section of the jaw slope permits the reduction of the total height of the jaws to be measured from the needle back. In so doing, the path that must be traveled by the stitch head on the shaft of the needle during the same time interval as the stitch limbs and the stitch feet of the half stitch is at least minimally reduced. Thus, the acceleration of the stitch head and, consequently, the acceleration of the latch and, as a result of this, the stress on them at the time of impact in back position are minimized.

With the use of the design in accordance with the invention, an excessive acceleration of the latch is prevented due to a reduction of the latch pivot range in which an acceleration of the latch occurs. The steeper first section of the upward jaw slope causes an early ascent of the half stitch seated in the inside space of the hook, when said half stitch slides in the direction of the latch bearing. When the half stitch abuts against the latch, an acceleration occurs (pivot angle range $\sigma$). When the half stitch moves on to the second, flatter section of the jaw slope, it has already overcome a large part of the ascent and may then slide over the needle breast at a relatively uniform speed thanks to the now smaller angle of friction. The latch is not or, at least, almost not accelerated. This pivot range is preferably greater than 90°. As soon as the half stitch leaves the second section, it again accelerates itself and the latch. This is the small angle range $\epsilon$. A large speed increase is not recorded in this small angle range $\epsilon$. Consequently, compared with prior art, said half stitch strikes the shaft at reduced speed with the latch in back position. This effect permits a substantial increase of the operating speed of the machine knitting needle.

The jaw slope may be embodied by a two-stage ramp, which ensures that the half stitch—after it has impacted the latch—must overcome a reduced slope angle.

In conjunction with this, it is further advantageous if the latch is concave on its side facing the inside space of the hook. On the one hand, this reduces the mass of the latch and, on the other hand, lets the half stitch impact the latch relatively late, that is, only at relatively small slope angles.

Additional details of advantageous embodiments of the invention are the subject matter of the drawings, the description or of the claims. The description addresses a few essential aspects of the invention, as well as miscellaneous situations. Additional aspects are obvious from the drawings. The drawings illustrate exemplary embodiments of the invention.

DETAILED DESCRIPTION OF THE INVENTION

Figure 1:
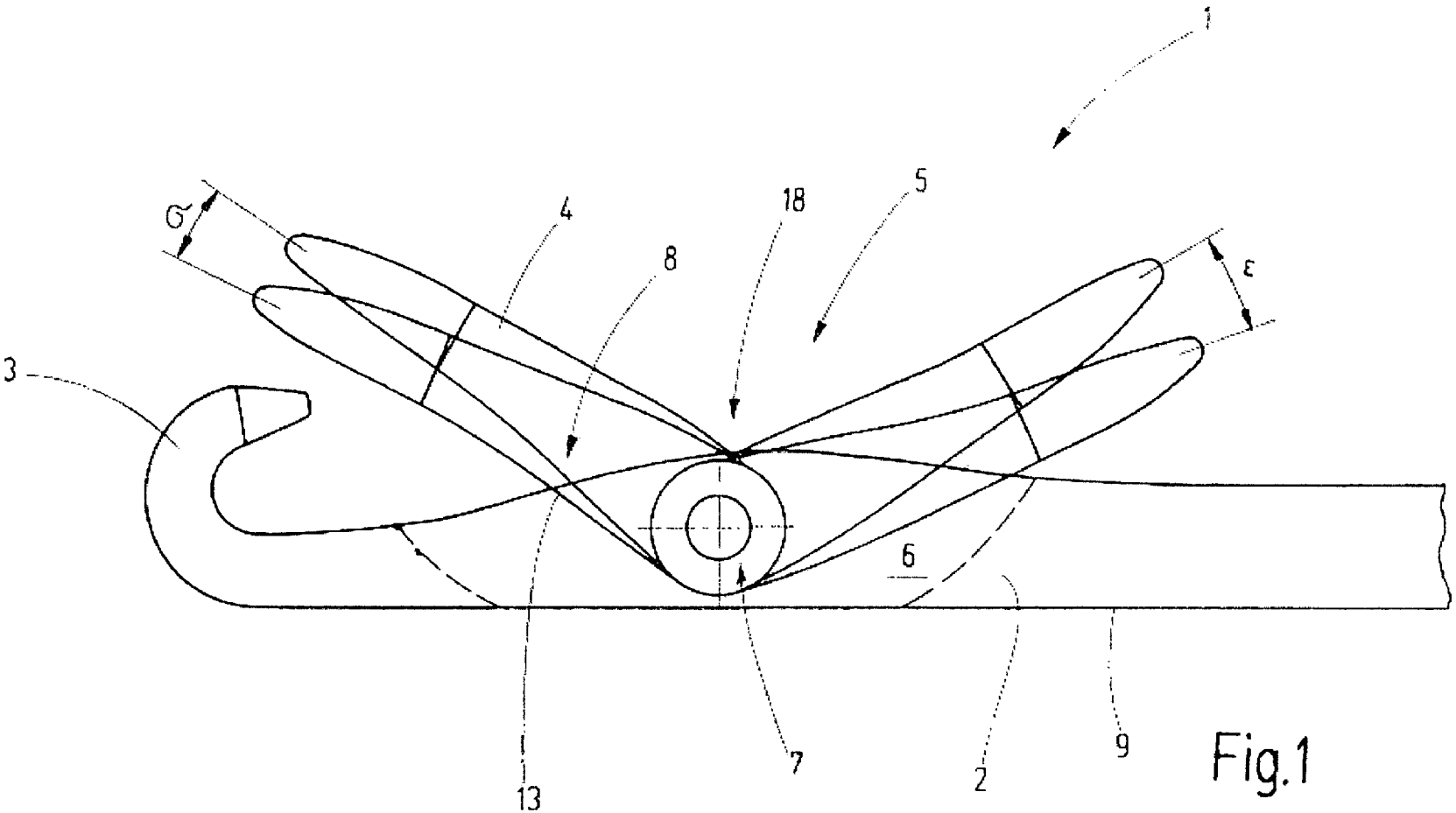
FIG. 1 is a detail of a schematic representation of the machine knitting needle in accordance with the invention, with the latch of the needle in different positions.
Figure 2:
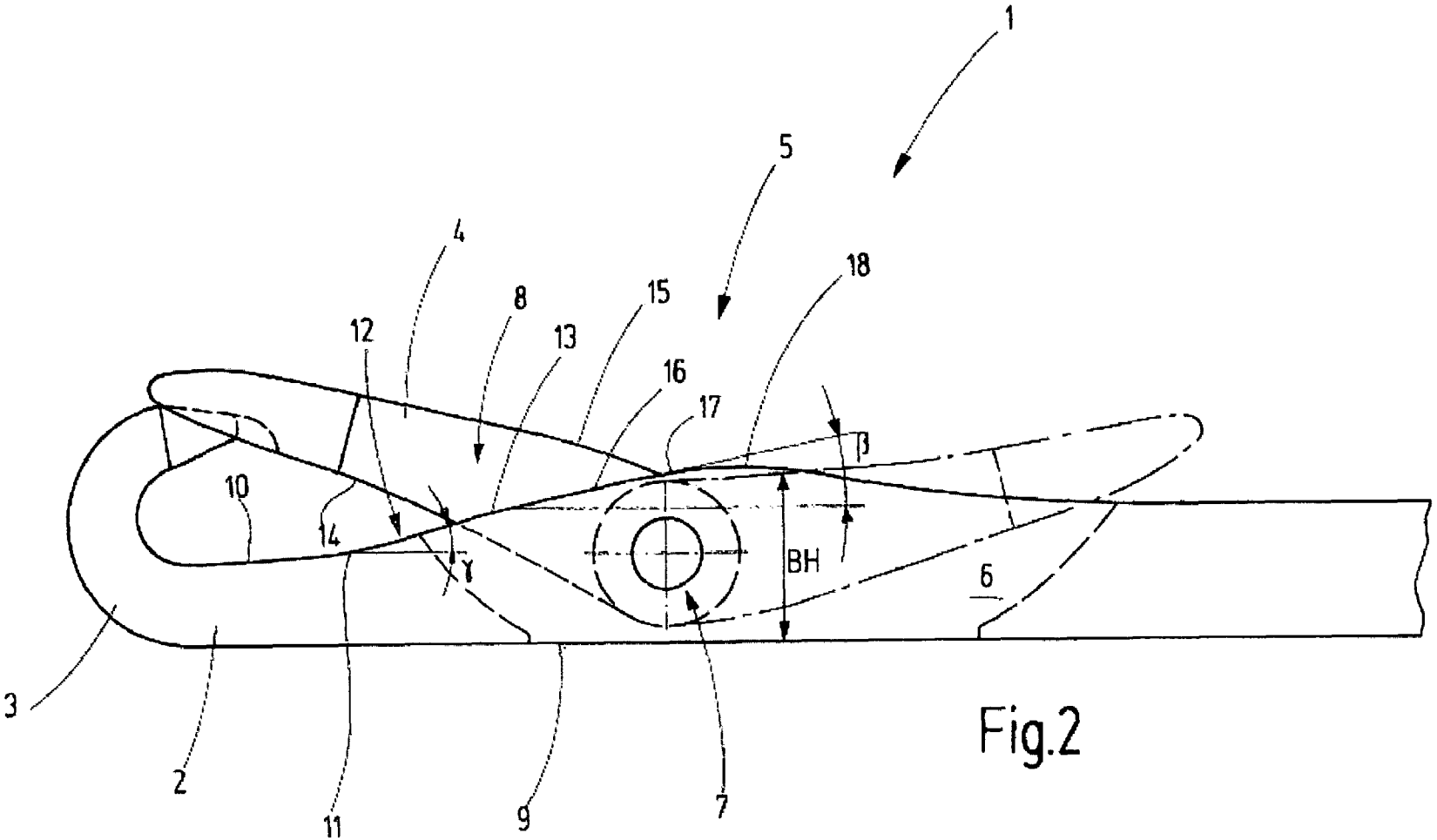
FIG. 2 is a side view of a detail of the needle in accordance with FIG. 1, with the needle having a different size and with the latch—viewed from the side—in closed position.

FIGS. 1 and 2 show a needle 1 that has a longitudinal shaft 2 which has a hook 3 formed to its end. For example, the shaft 2 terminates in a meander-shape needle body with a suitable means for driving the machine knitting needle 1, for example, configured as a not illustrated foot. The hook 3 is associated with a latch 4 which projects at an upwardly convex location of the shaft 2—referred to as the needle breast 5—from a latch slit 6, in which the latch bearing 7 is supported in a pivotable manner. The latch bearing 7 is only schematically indicated in FIG. 1, as well as in the remaining Figures. This bearing makes it possible to move the latch 4 into a closed position, in which it abuts against the hook 3 (shown in a solid line in FIG. 2), and into a back position (shown in a dashed line in FIG. 2), in which the latch is pivoted as far as possible away from the hook 3.

The needle breast 5 is provided with an upward jaw slope 8 extending as a contour opposite the needle back 9 away from the hook 3 over the latch bearing 7. This upward jaw slope 8 is preferably subdivided into several sections. A hook-side section forming a region 10, viewed from the side, is preferably straight and begins below the hook 3. It extends approximately parallel to the needle back 9 or at a slope angle of a few degrees. A first section 12 that is preferably straight when viewed from the side begins at a point 11. The point 11 is adjacent the inside space of the hook, said space being limited by the latch 4, the shaft 2 and the hook 3. The slope of the first section 12 is defined by a slope angle $\gamma$. Preferably, this angle ranges between 5° and 20. In so doing, the slope angle $\gamma$ is defined as the angle between the section 12 and the needle back 9. Preferably, at point 11, a curved transition is provided between the region 10 and the first section 12.

The first section 12 extends up to a point 13 next to the latch 4 when said latch is in closed position. The side view of the needle indicates that the point 13 can be found between a latch inside 14 and a latch back 15. At point 13, the upward jaw slope 8 terminates in a second straight section 16 which has a slope angle $\beta$. This slope angle $\beta$ and a slope angle $\gamma$ as well must be measured relative to the needle back 9. Slope angle $\gamma$ is smaller, preferably significantly smaller, than the slope angle $\beta$ of the first section 12. The straight section 16 preferably continues up to a point 17 which is still located next to the latch 4, however, when viewed from the perspective of the hook 3, preferably behind the latch back 15. A preferably curved reversal section 18, in which the jaw 5 reaches its greatest height BH, begins at point 17. Beyond the reversal section 18, the shaft 2 becomes slimmer again. From the perspective of the hook 3, the reversal section 18 is preferably located behind the latch bearing 7.

Figures 3, 4:
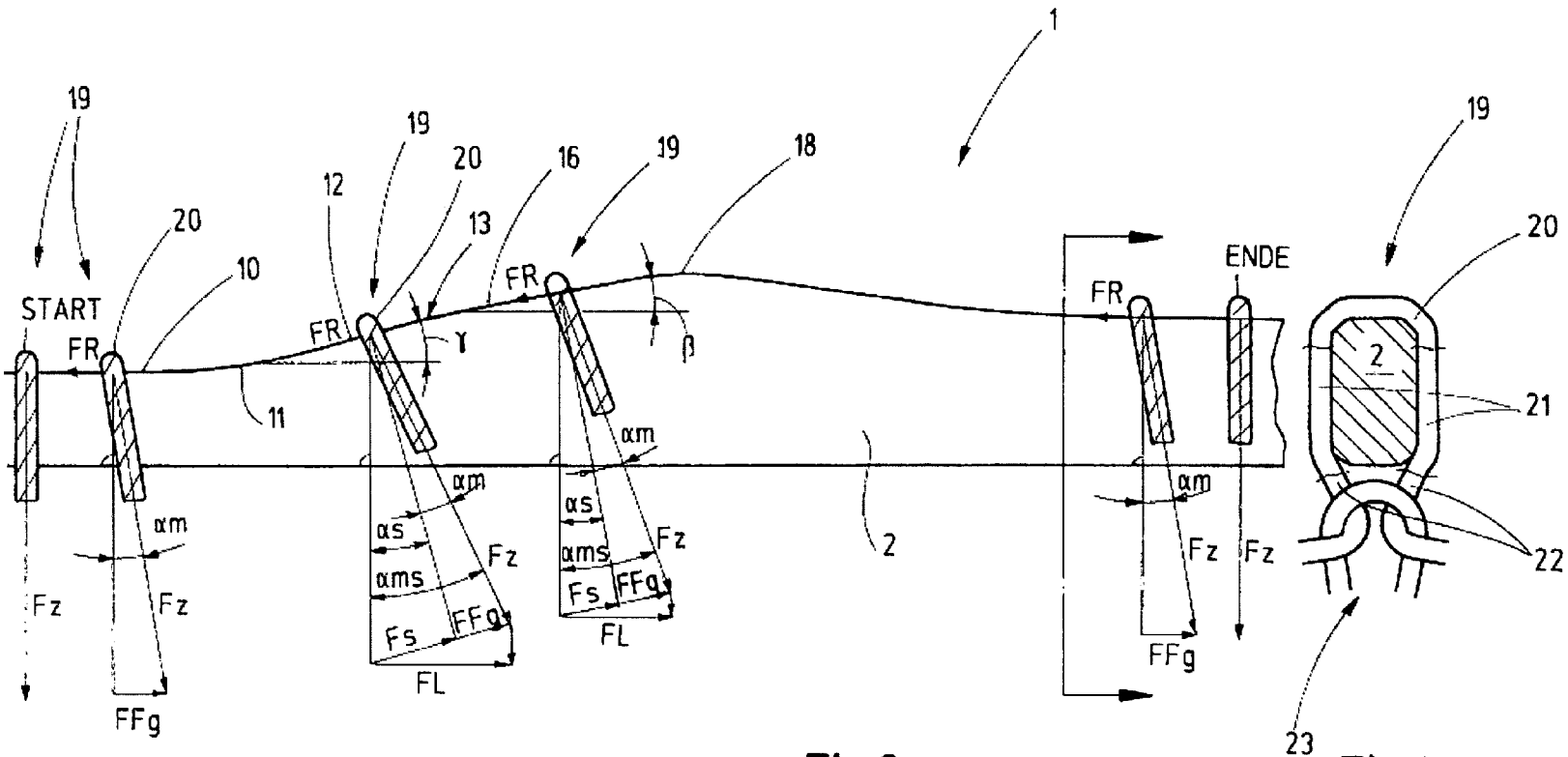
FIG. 3 is a side view of a detail of the needle in accordance with FIG. 1, with the needle having a different size with a half stitch—viewed from the side.
FIG. 4 is a sectional view of the needle in accordance with FIG. 1, with knitted fabric.

Referring to FIGS. 3 and 4, this configuration of the needle 1 or of the upward jaw slope 8 results in the below-described behavior of the knitted fabric when a half stitch 19 is transferred out of the inside space of the hook over the open latch 4 and onto the shaft 2. Preferably, the inside space of the hook is concave, so that the pick-up of at least one thread is reliably ensured. The inside space of the hook should be as large as possible to allow the safe pick-up of at least one thread. A picked up thread that forms a half stitch 19 is transferred out of this inside space of the hook over the open latch 4 onto the shaft 2 as described below.

In accordance with FIG. 4, the half stitch 19 is formed of a thread and consists of a head 20, two adjoining limbs 21 and two stitch feet 22. The half stitch 19 is anchored by the stitch feet 22 in the already produced knitted fabric 23.

As is shown on the left side of FIG. 3, a take-off force $F_z$ is applied to the knitted fabric 23, said force being transmitted to the half stitch 19.

If the needle 1 is driven out, a frictional force $F_R$ is generated between the stitch head 20 and the surface of the shaft 2. As a result, a relative motion is initially prevented, and the half stitch 19 is carried somewhat along by the needle 1 in the direction of movement. Referring to FIG. 3, second point from the left, the oblique position of the half stitch 19 at an angle of $\alpha_m$ is shown. The stitch head 20 moves only in the direction of point 11 when the horizontal component of force $F_{Fg}$ (thread sliding force in the region 10) is greater than the frictional force $F_R$.

As the needle 1 continues to move, the half stitch 19 slides onto the first section 12. In order for the stitch head 20 to move, an additional force $F_S$ must be applied here. This force $F_S$ corresponds to the slope angle $\gamma=\alpha_S$, as a result of which the oblique position of the half stitch 19 increases significantly. This position is expressed as the angle $\alpha_{ms}$ that represents the sum of the angle $\alpha_m$ plus the angle $\alpha_S$. When the half stitch 19 then moves over the point 13 in the transition region to the second section 16, the force required to drive the half stitch 19 decreases due to the reduced slope angle $\beta$ of the second section 16 when compared with the slope angle $\gamma$ of the first section 12. As a result of this, the obliqueness of the position—namely, the angle $\alpha_{ms}$—of the half stitch 19 is also diminished, and the head 20 of the half stitch 19, or the half stitch 19 as a whole, can accelerate somewhat. This corresponds to the angle range $\sigma$ for the latch 4 in FIG. 1. Consequently, the latch 4 is accelerated in this angle range $\sigma$. Then, the half stitch moves through the second section 16, without additional substantial acceleration. Therefore, the latch pivots—essentially not accelerated—out of the region shown in FIG. 1 on the left side and into the region shown in FIG. 1 on the right side. It is only when the half stitch 19 passes the reversal section 18 that an additional significant acceleration of the relative speed between the head 20 of the half stitch 19, or the half stitch 19 as a whole, and the shaft 2 of the needle 1 will occur. This corresponds to the acceleration range $\epsilon$ of the latch 4 in FIG. 1, right-hand side.

Figure 5:
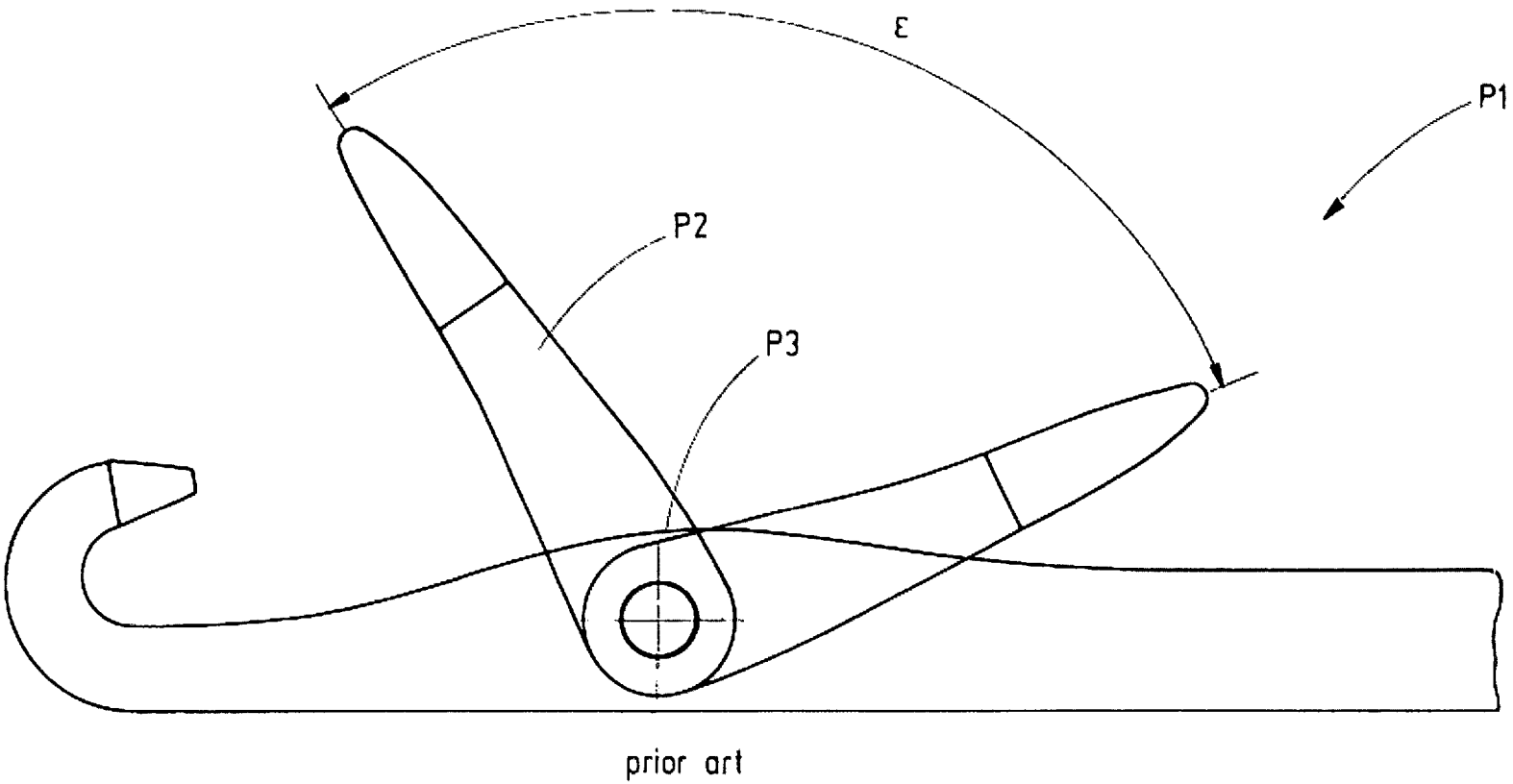
FIG. 5 is a detail of a side view of a needle in accordance with prior art.

Referring to the needle 1 in accordance with the invention, the acceleration ranges $\delta$ and $\epsilon$ are substantially smaller than in the prior-art Needle P1 in accordance with FIG. 5. Between them, is a large pivot range, without substantial acceleration of the latch 4. Consequently, the speed of the latch 4 at the time of impact on the shaft 2 has been minimized. This results in a reduced kinetic energy at the time of impact of the latch head in back position. In this way, a breakage of the latch head and the jaws is largely prevented, even at higher knitting speeds.

In order to reduce the impact speed of a latch 4 of a needle 1 in back position by reducing the acceleration effect originating from a half stitch 19, the upward jaw slope 8 of the needle 1 is subdivided into different regions. A first section 12 ascends at a relatively large acute angle γ of, for example, up to 20°, preferably 16°. Just after the half stitch 19 has contacted the inside 14 of the latch 4, said half stitch arrives on a second section 16 of the upward jaw slope 8. The second section 16 is a straight section which ascends at a smaller acute angle β of, for example, only 14° or less. Consequently, an acceleration effect from the half stitch 19 on the latch 4 is avoided over a wide pivot range of said latch. Preferably, this acceleration-free pivot range is at least 90°, preferably greater than 110°.

It will be appreciated that the above description of the present invention is susceptible to various modifications, changes and adaptations, and the same are intended to be comprehended within the meaning and range of equivalents of the appended claims.

LIST OF REFERENCE NUMBERS

1 Machine knitting needle
2 Shaft
3 Hook
4 Latch
5 Needle breast
6 Latch slit
7 Latch bearing
8 Upward jaw slope
9 Latch back
10 Region
11 Point
12 First section
13 Point
14 Latch inside
15 Latch back
16 Second section
17 Point
18 Reversal section
19 Half stitch
20 Stitch head
21 Stitch limbs
22 Stitch feet
23 Knitted fabric

The invention claimed is:

1. Machine knitting needle comprising:

a needle shaft having a hook formed to its free end;

a latch, which is supported in a needle slit of the shaft by a latch bearing so as to be pivotable between a closed position and a back position;

wherein the shaft, starting from the hook and up to the latch bearing, has an upwardly inclined sloped breast with a first section and with a second section; and, wherein the second section is straight and has a slope angle (β) which is greater than 0° but is smaller than a slope angle (γ) defined by the first section.

2. Machine knitting needle in accordance with claim 1, wherein the first section is straight.

3. Machine knitting needle in accordance with claim 1, wherein a curved transition section is formed between the first section and the second section.

4. Machine knitting needle in accordance with claim 1, wherein a curved transition section is formed between the first section and the second section, which transition section is laterally adjacent to the latch when said latch is in the closed position.

5. Machine knitting needle in accordance with claim 1, wherein the second section extends up to a reversal region in which the upwardly inclined sloped breast has its greatest height, measured from the needle back.

6. Machine knitting needle in accordance with claim 2, wherein the length of the second section corresponds to a pivot range of the latch greater than 90°.

7. Machine knitting needle in accordance with claim 1, wherein the first section and the second section, together, subtend an oblique angle (180°−β) which is greater than 165° and less than 180°.

8. Machine knitting needle in accordance with claim 1, wherein the slope angle (β) is greater than or equal to 5°.

9. Machine knitting needle in accordance with claim 1, wherein the slope angle (β) is less than or equal to 14°.

10. Machine knitting needle in accordance with claim 1, wherein the latch is concave on its side facing the shaft.

* * * * *